US008212195B2

(12) United States Patent
Geswender

(10) Patent No.: US 8,212,195 B2
(45) Date of Patent: Jul. 3, 2012

(54) PROJECTILE WITH INERTIAL MEASUREMENT UNIT FAILURE DETECTION

(75) Inventor: Chris E. Geswender, Green Valley, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 13/235,246

(22) Filed: Sep. 16, 2011

(65) Prior Publication Data

US 2012/0025008 A1 Feb. 2, 2012

Related U.S. Application Data

(63) Continuation of application No. 12/359,156, filed on Jan. 23, 2009.

(51) Int. Cl.

| | |
|---|---|
| ***F41G 7/36*** | (2006.01) |
| ***F42B 15/01*** | (2006.01) |
| *F41G 7/00* | (2006.01) |
| *F42B 15/00* | (2006.01) |

(52) U.S. Cl. ..... 244/3.2; 701/1; 701/3; 701/4; 701/400; 701/408; 701/468; 701/469; 701/500; 102/501; 244/3.1; 244/3.15; 244/3.24

(58) Field of Classification Search ..... 244/3.1–3.3; 701/1–18, 200, 207, 213, 400, 408, 468, 701/469, 500–512; 89/1.11, 1.1, 1.8; 102/382, 102/384, 473, 501

See application file for complete search history.

(56) References Cited

U.S. PATENT DOCUMENTS

| | | | | |
|---|---|---|---|---|
| 4,444,086 | A * | 4/1984 | White | 244/3.1 |
| 4,470,562 | A | 9/1984 | Hall et al. | |
| 4,495,850 | A * | 1/1985 | White | 244/3.1 |
| 4,589,610 | A | 5/1986 | Schmidt | |
| 4,623,106 | A | 11/1986 | Price, Jr. et al. | |
| 5,058,836 | A | 10/1991 | Nobel | |
| 5,232,182 | A | 8/1993 | Hamilton | |
| 5,260,706 | A | 11/1993 | Chung | |
| 5,435,503 | A | 7/1995 | Johnson, Jr. et al. | |
| 5,455,587 | A | 10/1995 | Schneider | |
| 5,660,355 | A | 8/1997 | Waymeyer | |
| 5,739,787 | A | 4/1998 | Burke et al. | |
| 5,775,636 | A | 7/1998 | Vig et al. | |
| 5,848,764 | A | 12/1998 | Schneider | |
| 5,948,045 | A * | 9/1999 | Reiner | 701/14 |
| 5,975,460 | A | 11/1999 | Elkanick et al. | |
| 6,131,068 | A * | 10/2000 | Kau | 244/3.1 |
| 6,181,988 | B1 | 1/2001 | Schneider et al. | |
| 6,317,688 | B1 | 11/2001 | Bruckner et al. | |
| 6,380,526 | B1 * | 4/2002 | Kau | 244/3.2 |

(Continued)

OTHER PUBLICATIONS

Honeywell International, Enabling Guided Artillery, Feb. 2007, N40-0733-000-001, Phoenix, AZ, USA.

(Continued)

*Primary Examiner* — Bernarr Gregory
(74) *Attorney, Agent, or Firm* — Eric A. Gifford

(57) ABSTRACT

A guided projectile may include a projectile body. An inertial measurement unit may be disposed within the projectile body, the inertial measurement unit including sensors to measure motion parameters relative to first, second, and third mutually orthogonal axes. Each of the first, second, and third mutually orthogonal axes may form an oblique angle with a longitudinal axis of the projectile body. A controller may be configured to control a trajectory of the guided projectile in response, at least in part, to measurement data received from the inertial measurement unit.

24 Claims, 8 Drawing Sheets

U.S. PATENT DOCUMENTS

| | | | | |
|---|---|---|---|---|
| 6,496,779 | B1 * | 12/2002 | Hwang | 244/3.1 |
| 6,564,146 | B1 * | 5/2003 | Meyer et al. | 701/213 |
| 6,573,486 | B1 | 6/2003 | Ratkovic et al. | |
| 6,596,976 | B2 | 7/2003 | Lin et al. | |
| 6,714,866 | B2 | 3/2004 | Jones et al. | |
| 6,779,752 | B1 | 8/2004 | Ratkovic | |
| 6,883,747 | B2 | 4/2005 | Ratkovic et al. | |
| 7,076,342 | B2 | 7/2006 | Fukuda et al. | |
| 7,133,766 | B2 | 11/2006 | Kokubo | |
| 7,183,966 | B1 | 2/2007 | Schramek et al. | |
| 7,248,967 | B2 * | 7/2007 | Hagstedt | 244/3.1 |
| 7,328,104 | B2 | 2/2008 | Overstreet et al. | |
| 7,338,009 | B1 | 3/2008 | Bobinchak et al. | |
| 7,422,175 | B1 | 9/2008 | Bobinchak et al. | |
| 7,513,455 | B1 | 4/2009 | Mavroudakis et al. | |
| 7,566,026 | B2 | 7/2009 | Lam et al. | |
| 7,631,833 | B1 * | 12/2009 | Ghaleb et al. | 244/3.15 |
| 7,645,970 | B2 | 1/2010 | Adams et al. | |
| 7,675,012 | B1 | 3/2010 | Bobinchak et al. | |
| 7,947,936 | B1 | 5/2011 | Bobinchak et al. | |

OTHER PUBLICATIONS

Raytheon, Inc., Excalibur, Precision-Guided, Long Range, 155mm Artillery Projectile, Jan. 2008, PR231699, Tucson, Arizona, USA.

Honeywell International, HG1930 MEMS IMU, Jun. 2006, DFOISR 05-S-0723, Phoenix, AZ, USA.

Honeywell International, Honeywell Tactical Inertial Measurement Units (IMU), Jul. 2007, N61-0628-000-000, Phoenix, AZ, USA.

Steven Nasri, "A Critical Review of MEMS Gyroscopes Technology and Commercialization Status," Journal, 8 pages, 2005.

Raytheon Company Missile Systems, "Excalibur Precision-Guided, Long-Range, 155mm Artillery Projectile," Jan. 2008, 2 pages.

* cited by examiner

PROJECTILE WITH INERTIAL MEASUREMENT UNIT FAILURE DETECTION

RELATED APPLICATION INFORMATION

This patent is a continuation of the following prior-filed copending non-provisional patent application: application Ser. No. 12/359,156, entitled Projectile With Inertial Sensors Oriented for Enhanced Failure Detection, filed Jan. 23, 2009, which is incorporated herein by reference.

GOVERNMENT INTERESTS

This invention was made with Government support under Contract N00024-96-C-5204 awarded by the Department of the Navy. The Government has certain rights in the invention.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to guided projectiles.

2. Description of the Related Art

Conventional artillery shells are projectiles that are fired from an artillery piece or other launcher and travel on a ballistic trajectory towards an intended target. A ballistic trajectory is a flight path that is governed by forces and conditions external to the projectile, such as the velocity provided at launch, gravity, air drag, temperature, wind, humidity, and other factors. A guided projectile is a projectile that exercises some degree of self-control over its trajectory. Typically, guided projectiles deploy some form of control surfaces after launch and use these control surfaces to control the trajectory. Guided projectiles may home on some feature of the intended target, such as a reflection of a laser designator beam. Guided projectiles may be programmed to navigate to specific geographic coordinates using one or more of inertial sensors, GPS positioning, and other navigation methods.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

Figure 1:
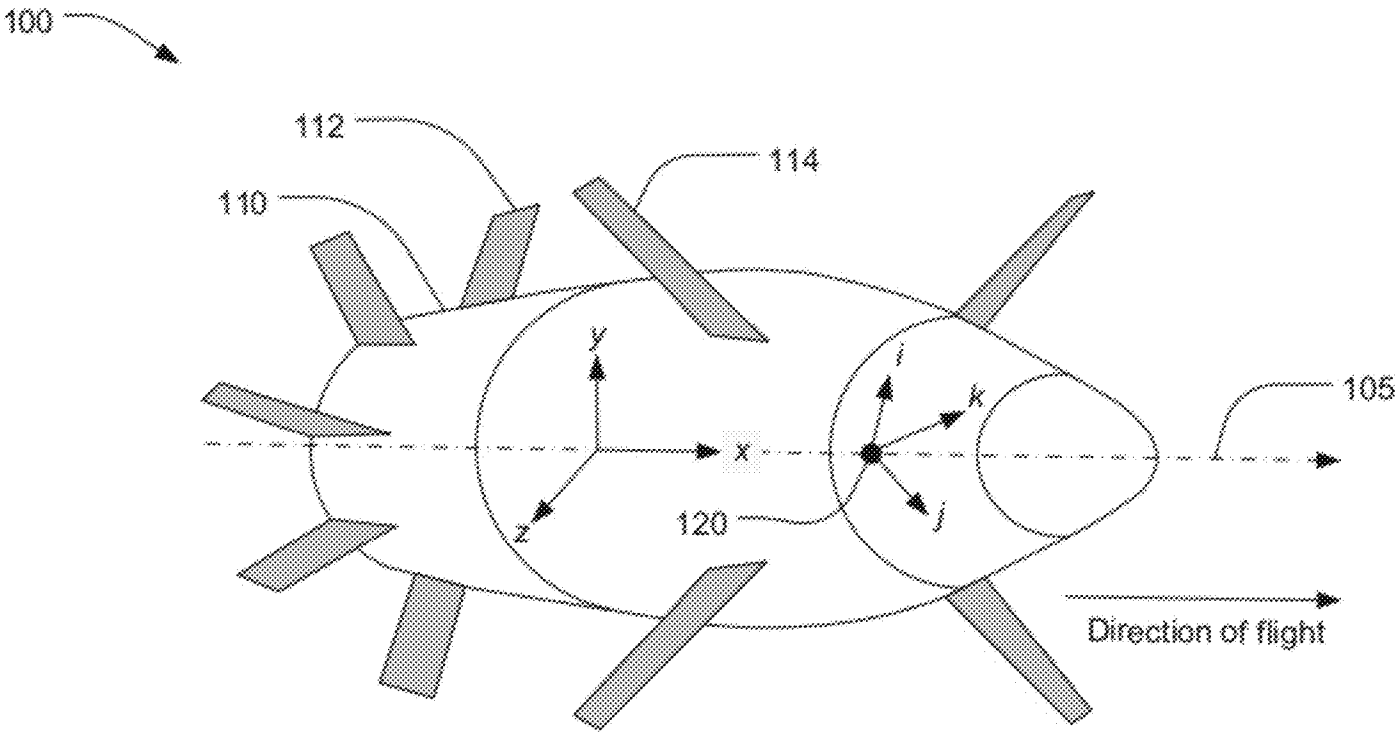
FIG. 1 is a perspective view of a guided projectile.

Referring now to FIG. 1, a guided projectile 100 may include a projectile body 110 which may be symmetrical about a longitudinal axis 105. The longitudinal axis 105 may be aligned with the direction of flight of the projectile at launch. The longitudinal axis 105 may deviate slightly from the direction of flight during subsequent guided flight. A plurality of fins 112 may extend from the projectile body. The fins 112 may be effective to stabilise the flight of the projectile. The fins 112 may extend from the projectile body 110 at or near the back of the projectile body 110.

One or more control surfaces 114 may extend from the projectile body 110. The one or more control surfaces 114 may be effective to control, to at least some degree, the flight of the projectile 100. In the example of FIG. 1, the control surfaces 114 are shown as a plurality of canards or fins extending from the projectile body 110 near the front of the projectile body 110. Other types of control surfaces, including drag brakes or scoops, wings, and fins disposed at other locations on the projectile body may be used to control the flight of the projectile. In some instances, the fins 112 may also function as the control surfaces 114.

The fins 112 and control surfaces 114 may be retained within the projectile body 110 prior to and during launch. The fins and control surfaces may not necessarily be enclosed by the projectile body but may be folded within the general outline of the projectile body such that the projectile may be launched from the barrel of an artillery piece or other launcher. The fins 112 and control surfaces 114 may be automatically or electively deployed or extended after launch. For example, the fins 112 may be automatically deployed after launch to stabilize the projectile. With only the fins 112 deployed, the projectile 100 may follow a ballistic flight path. Subsequently, the control surfaces 114 may be electively deployed when the guided portion of the projectile flight begins.

The projectile body 110 may enclose an explosive payload (not shown) and a control system (not shown) to control the flight of the projectile using the control surfaces 114. The projectile body 110 may also enclose a navigation system which may include an inertial measurement unit 120 to measure projectile motion parameters such as acceleration and angular rate. In a conventional guided projectile, an inertial measurement unit typically measures motion parameters with respect to mutually orthogonal x, y, and z axes, one of which (the x axis in FIG. 1) would be aligned with the longitudinal axis 105 of the missile body 110. The other 2 sensor axes may be aligned to the rotation axes of the control surfaces 114. Typical inertial measurement units include, for example, accelerometers to measure linear acceleration along the orthogonal x, y, and z axes and gyroscopes or other rate sensors to measure rotation rate about the orthogonal x, y, and z axes.

The missile body 110 may enclose other navigation equipment (not shown) such as a GPS receiver. For example, U.S. Pat. No. 6,883,747 B2 describes a projectile guided by a combination of a GPS receiver and an internal inertial measurement unit. The missile body 110 may also enclose one or more sensors (not shown), such as a semi-active laser (SAL) guidance system, to guide the projectile to a target.

Figure 2:
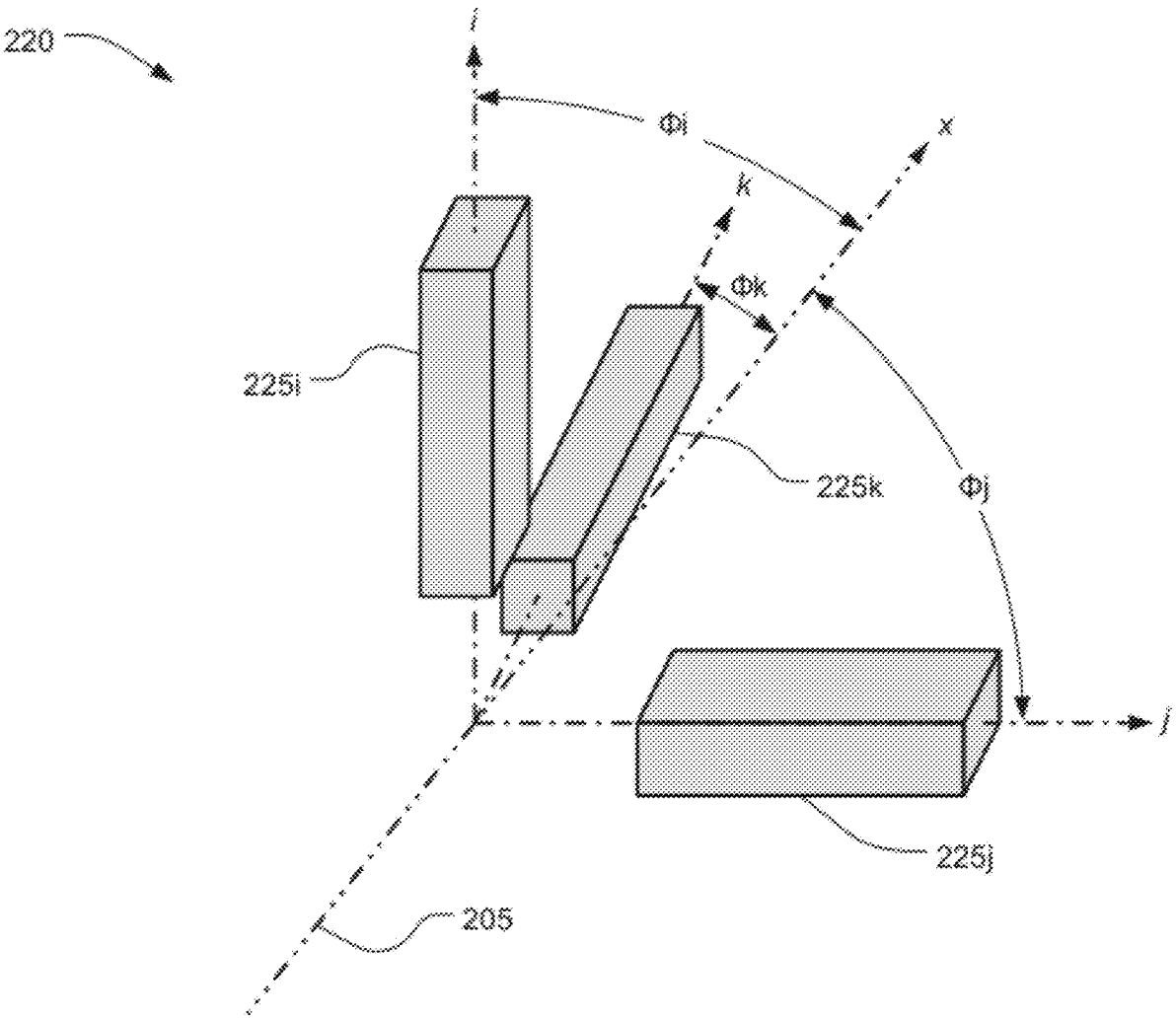
FIG. 2 is a perspective block diagram of an inertial measurement unit for a guided projectile.

FIG. 2 is a perspective block diagram of an inertial measurement unit 220, which may be the inertial measurement unit 120 of FIG. 1, which includes sensor suites 225*i*, 225*j*, and 225*k* disposed to measure motion parameters with respect to mutually orthogonal i, j, and k axes, respectively. Each of the sensor suites 225*i*, 225*j*, and 225*k* may include, for example, an accelerometer to measure linear acceleration along the respective axis and a gyroscope or other rate sensor to measure rotation rate about the respective axis. The accelerometers and gyroscopes in the sensor suites 225*i*, 225*j*, and 225*k* may be implemented using MEMS (micro electro-mechanical system) technology, but other types of motion sensors such as fiber gyroscopes may also be used. In contrast to a typical inertial measurement unit, each of the i, j, and k axes of the inertial measurement unit 220 are oblique to a projectile longitudinal axis 205. In this context, "oblique" means "not perpendicular or parallel". Rather, each of the i, j, and k axes forms an oblique angle (ϕi, ϕj, ϕk, respectively) with the projectile axis.

The benefit of the inertial measurement unit 220 may be understood by considering the motion of the projectile shortly after launch. During launch, the projectile and the inertial measurement unit may be subject to extremely high acceleration which may, on occasion, damage the motion sensors within the inertial measurement unit. Thus the motion sensors are typically not used during launch, but are activated shortly after launch. Shortly after launch, the projectile may experience deceleration along the longitudinal axis 105/205 due to atmospheric drag. In additional, many projectiles are caused to rotate or roll about the longitudinal axis 105/205 during launch. Thus, shortly after launch, a typical inertial measurement unit, which has the x axis parallel to the projectile axis 105 and the y and z axes orthogonal to the projectile axis 105, may measure deceleration along the x axis and rotation about the x axis, but nearly no motion with respect to either the y or z axes. Thus it may not be possible to determine, shortly after launch, if a prior art inertial measurement unit is functioning and capable of correctly measuring motion parameters with respect to the y and z axes.

Figure 3:
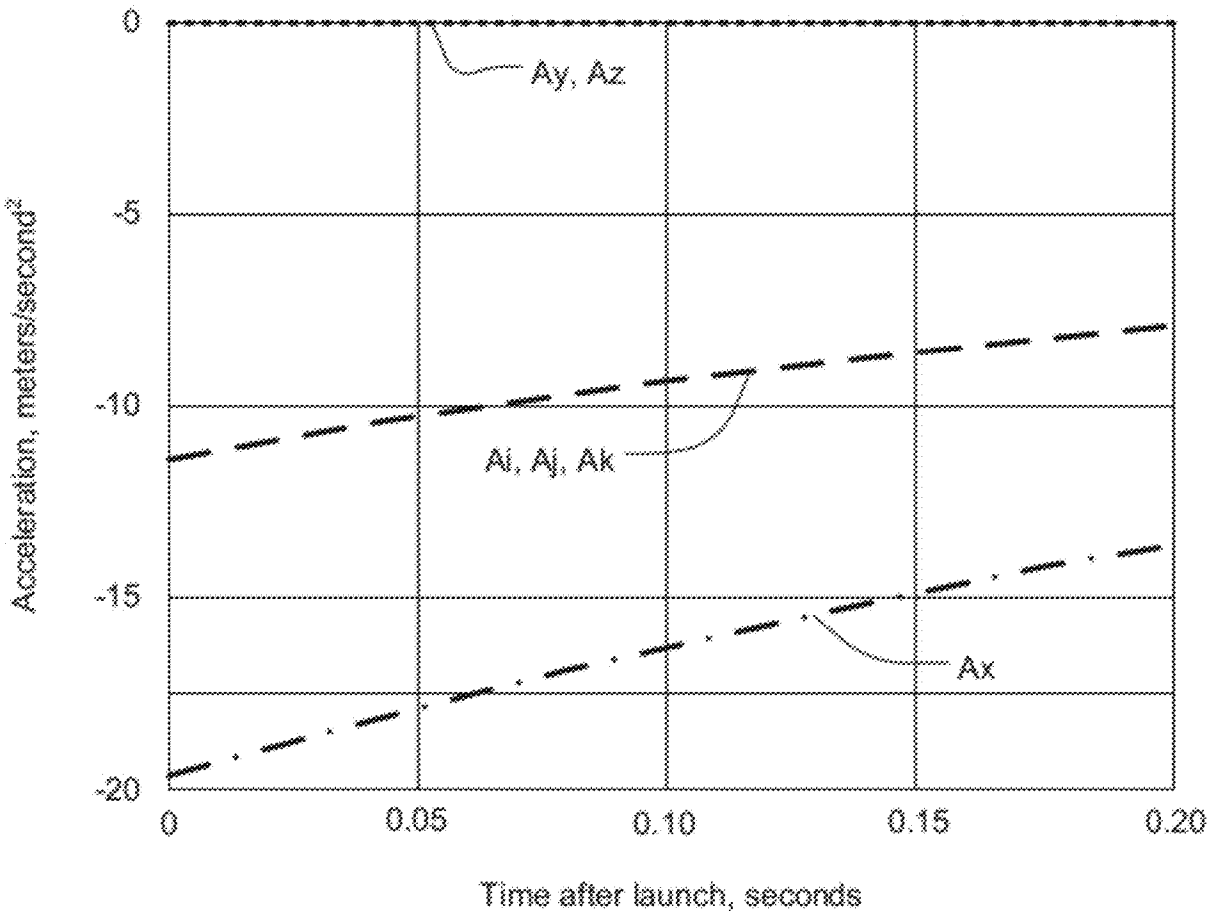
FIG. 3 is a graph of the acceleration of an exemplary projectile.

Referring again to FIG. 2, deceleration along the projectile longitudinal axis 205 will have a measurable component along each of the mutually orthogonal i, j, and k axes since the i, j, and k axes are all oriented oblique to the projectile longitudinal axis 205. FIG. 3 shows the acceleration of an exemplary projectile immediately after launch. As shown in FIG. 3, accelerometers oriented along orthogonal i, j, and k axes will measure deceleration (negative acceleration) Ai, Aj, Ak immediately after launch. In this example, it is assumed that the angles between the i, j, and k axes and the longitudinal axis of the projectile are equal. In contrast, with conventionally oriented sensors, only the accelerometer oriented along the x axis measures the initial deceleration Ax of the projectile.

Figure 4:
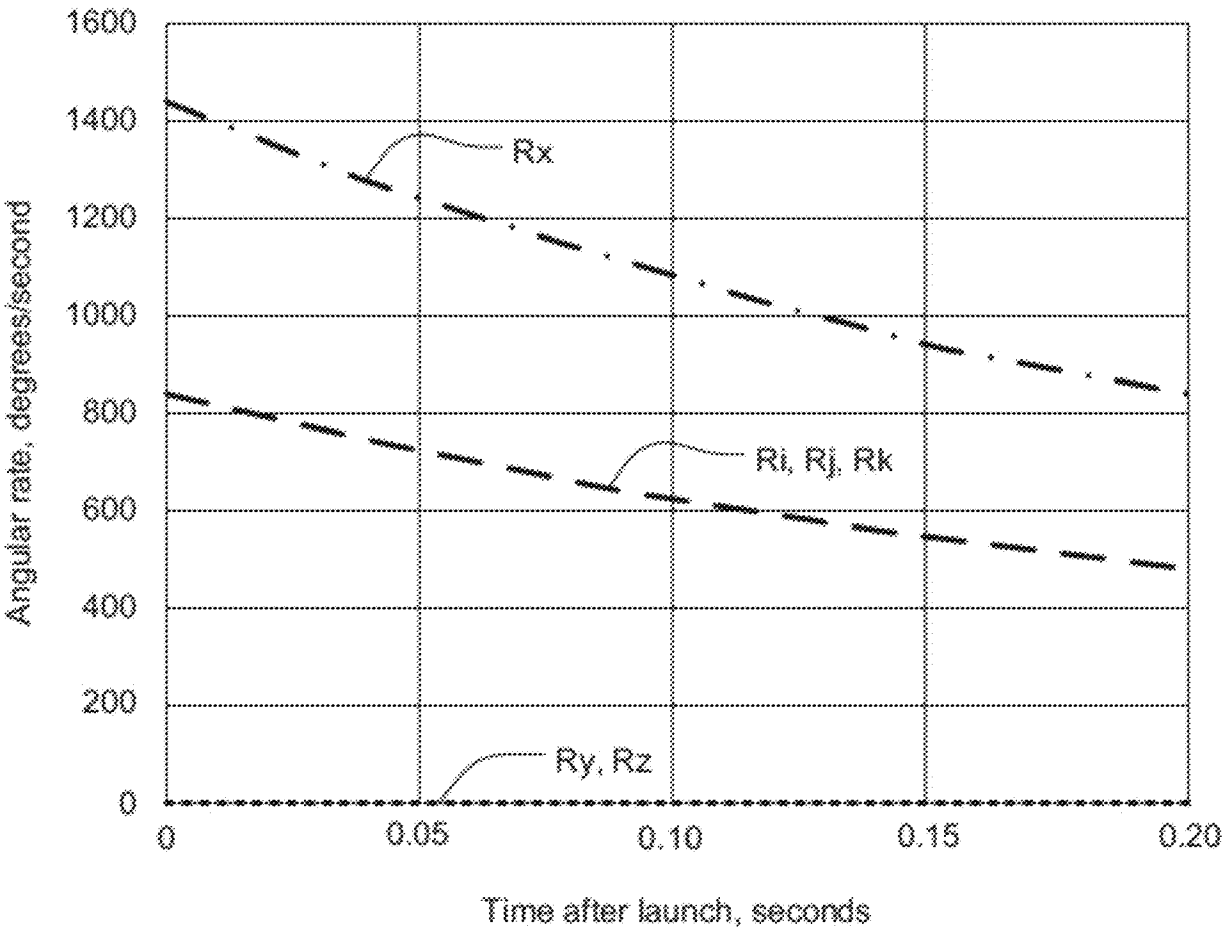
FIG. 4 is a graph of the angular rate of an exemplary projectile.

Further, due to the orientation of the i, j, and k axes, the roll about the projectile axis 205 will also have a measurable rotation rate component about each of the mutually orthogonal i, j, and k axes. FIG. 4 shows the angular rate of the exemplary projectile immediately after launch. As shown in FIG. 3, rate sensors oriented along orthogonal i, j, and k axes will measure a component Ri, Rj, Rk, respectively, of roll about the longitudinal axis after launch. In contrast, with conventionally oriented sensors, only the rate sensor oriented along the x axis measures the initial roll Rx of the projectile.

Thus, shortly after launch, each of the sensor suites 225*i*, 225*j*, 225*k* may measure a component of the deceleration along the projectile axis 205 and each of the sensor suites 225*i*, 225*j*, 225*k* may measure a component of the roll about the projectile axis 205 if roll is introduced during launch. Thus the performance of the sensor suites 225*i*, 225*j*, 225*k* may be verified by comparing the acceleration and/or rotation rate values measured by each sensor suite. If the inertial measurement unit 220 is disposed such that the angles ϕi, ϕj, ϕk, are equal, each of the sensor suites 225*i*, 225*j*, 225*k* may measure equal acceleration and rotation with respect to their respective axis in the critical early launch phase. In the case where the angles ϕi, ϕj, ϕk, are not equal, the acceleration and/or rotation values measured by each sensor suite may be scaled appropriately before comparison.

Figure 5:
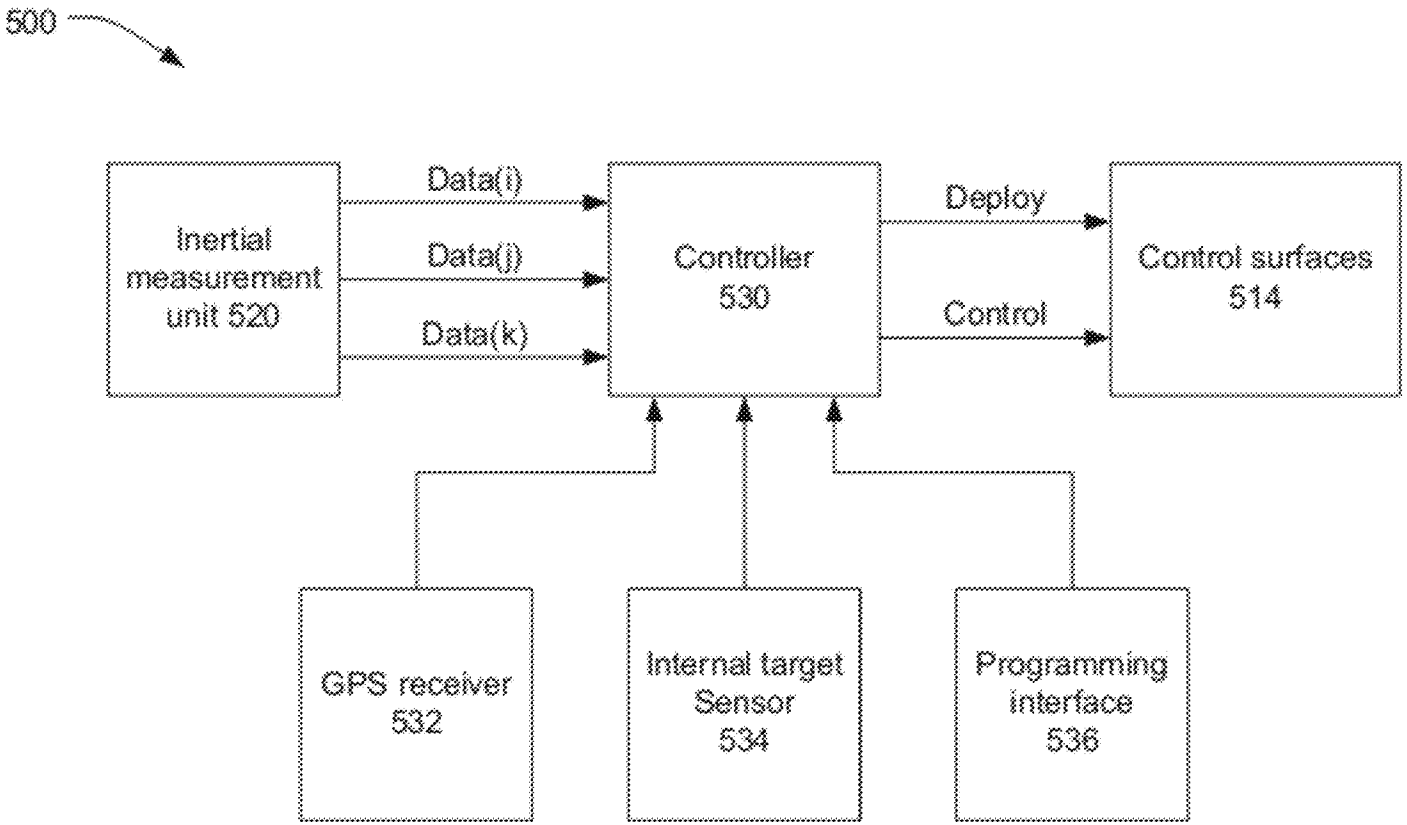
FIG. 5 is a block diagram of a guided projectile.

Referring now to FIG. 5, a projectile 500 may include an inertial measurement unit 520 which provides measurement data to a controller 530. The inertial measurement unit 520 may be the inertial measurement unit 220 and may provide the controller 530 with measurement data Data(i), Data (j), Data (k) with respect to orthogonal i, j, and k axes which are oriented oblique to a longitudinal axis of the projectile 500.

Shortly after the projectile 500 is launched, the controller 530 may make a determination if the inertial measurement unit 520 is functioning within predetermined tolerances. For example, the controller 530 may receive from the inertial measurement unit 520 measurement data indicating acceleration along and rotation rate about the orthogonal i, j, and k axes. Shortly after launch, the controller 530 may compare the measured acceleration and rotation rate data with respect to each of the i, j, and k axes and determine if one or more measurement is outside of an expected tolerance range relative to the other measurements. In the event that the controller 530 determines that the inertial measurement unit 520 is not functioning within predetermined tolerances, the controller 530 may inhibit deployment of the one or more control surfaces 514. In the case where deployment of the control surfaces is inhibited, the projectile 500 may continue along a ballistic flight path.

In the event that the controller 530 determines that the inertial measurement unit 520 is functioning within predetermined tolerances, the controller 530 may provide one or more control signals to cause the control surfaces 514 to deploy when a guided portion of the projectile flight is to start. Subsequently, the controller 530 may control one or more control surfaces 514 based, at least in part, on the measurement data received from the inertial measurement unit 520. The controller 530 may provide one or more control signals to drive or control the control surfaces 514 to guide the flight of the projectile 500. For example, each of the one or more control surfaces 514 may be coupled to a motor, a solenoid, or another actuator effective to adjust the position of the control surface. The controller 520 may provide control signals to drive the actuator coupled to each control surface.

The controller 530 may control the one or more control surfaces 514 based, at least in part, on inputs from one or more of a GPS receiver 532, a target sensor 534 within the projectile 500, and a programming interface 536. The controller 530 may also include or perform the function of a fuse to detonate an explosive payload (not shown) within the projectile 500. The programming interface may be used prior to the launch of the projectile 530 to program a mission for the projectile including an intended destination and fuse parameters.

The controller 530 may include software, firmware, and/or hardware for providing functionality and features described herein. The hardware and firmware components of the controller 530 may include various specialized units, circuits, software and interfaces for providing the functionality and features described here. The controller 530 may therefore include one or more of: memories, analog circuits, digital circuits, and processors such as microprocessors, field programmable gate arrays (FPGAs), application specific integrated circuits (ASICs), programmable logic devices (PLDs) and programmable logic arrays (PLAs). The functionality and features of the controller 530 may be embodied in whole or in part in software which operates on one or more processors within the controller 530 and may be in the form of firmware, an application program, an applet (e.g., a Java applet), a dynamic linked library (DLL), a script, one or more subroutines, or an operating system component or service. The hardware and software and their functions may be distributed such that some functions are performed by the controller 530 and others by other devices.

Description of Processes

Figure 6:
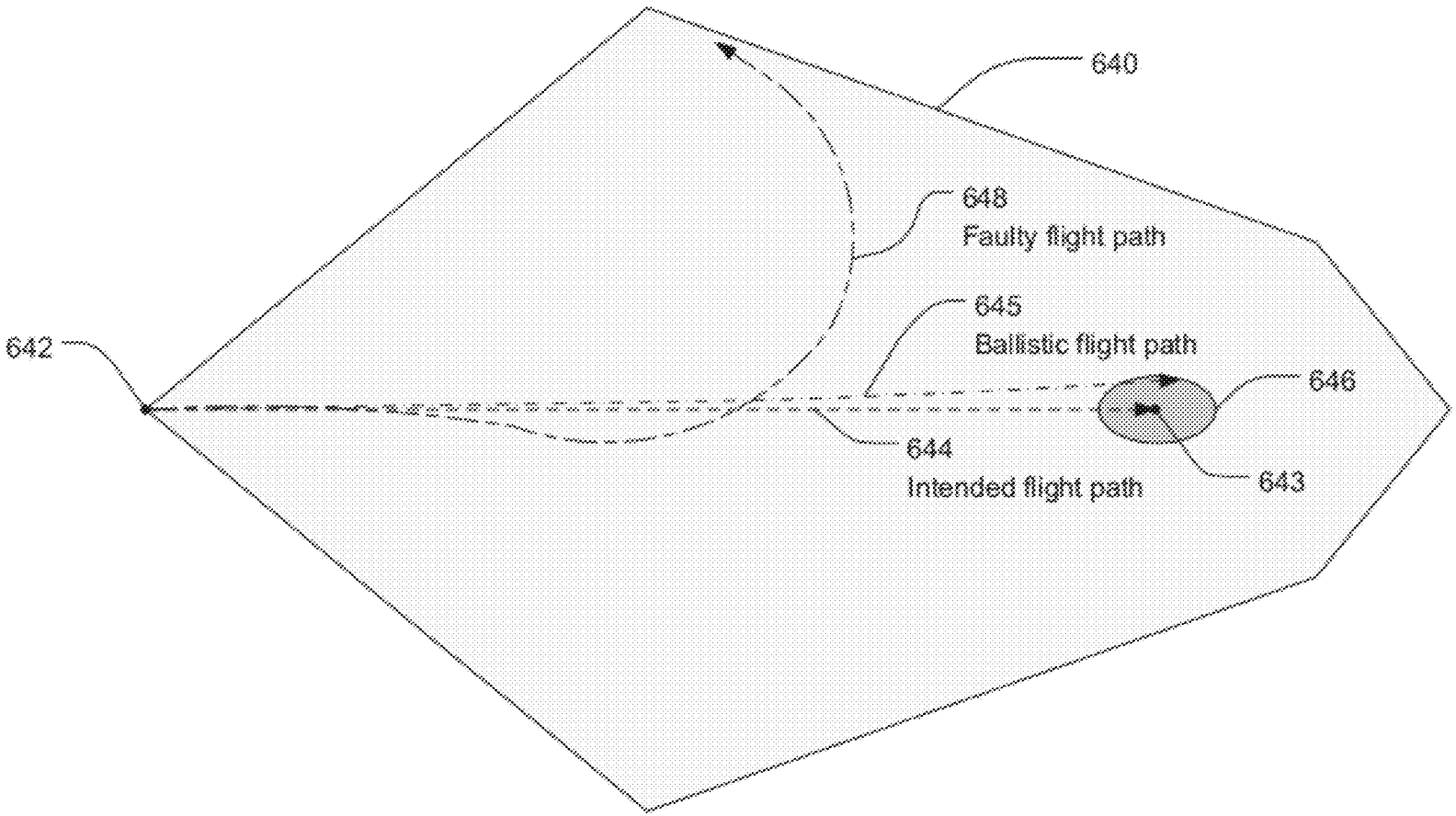
FIG. 6 is a plan view showing possible projectile trajectories.

FIG. 6 shows a plan view illustrating the flight of a projectile under various conditions. FIG. 6 presumes that a projectile is launched at a first point 642 and is intended to travel along a flight path 644 to impact at a target point 643. An unguided ballistic projectile may follow a ballistic flight path 645 that deviates from the intended flight path 644 due to unforeseen factors such as wind, precipitation, and random variations in the projectile and the launcher. Thus the impact point of an unguided projectile may deviate from the intended impact point by an error margin, which may be represented by an error ellipse 646.

Ideally, navigation and control systems within a guided projectile compensate for random variations and atmospheric effects and cause the guided projectile to follow the intended flight path 644 and to impact precisely at the target point 643. However, in the event of a fault or failure in the navigation and control systems, a guided projection may have a potential to follow a flight path that deviates substantially from the intended flight path 644. For example, a faulty guided projectile may follow a flight path such as the exemplary faulty flight path 648. The shaded polygon 640 indicates the locations of all hypothetical impact points for a specific projectile having a faulty navigation and control system. The polygon 640 is provided as an example. The locus of possible impacts points may be highly dependent on the projectile design, and thus may be different for each type of guided projectiles.

Figure 7:
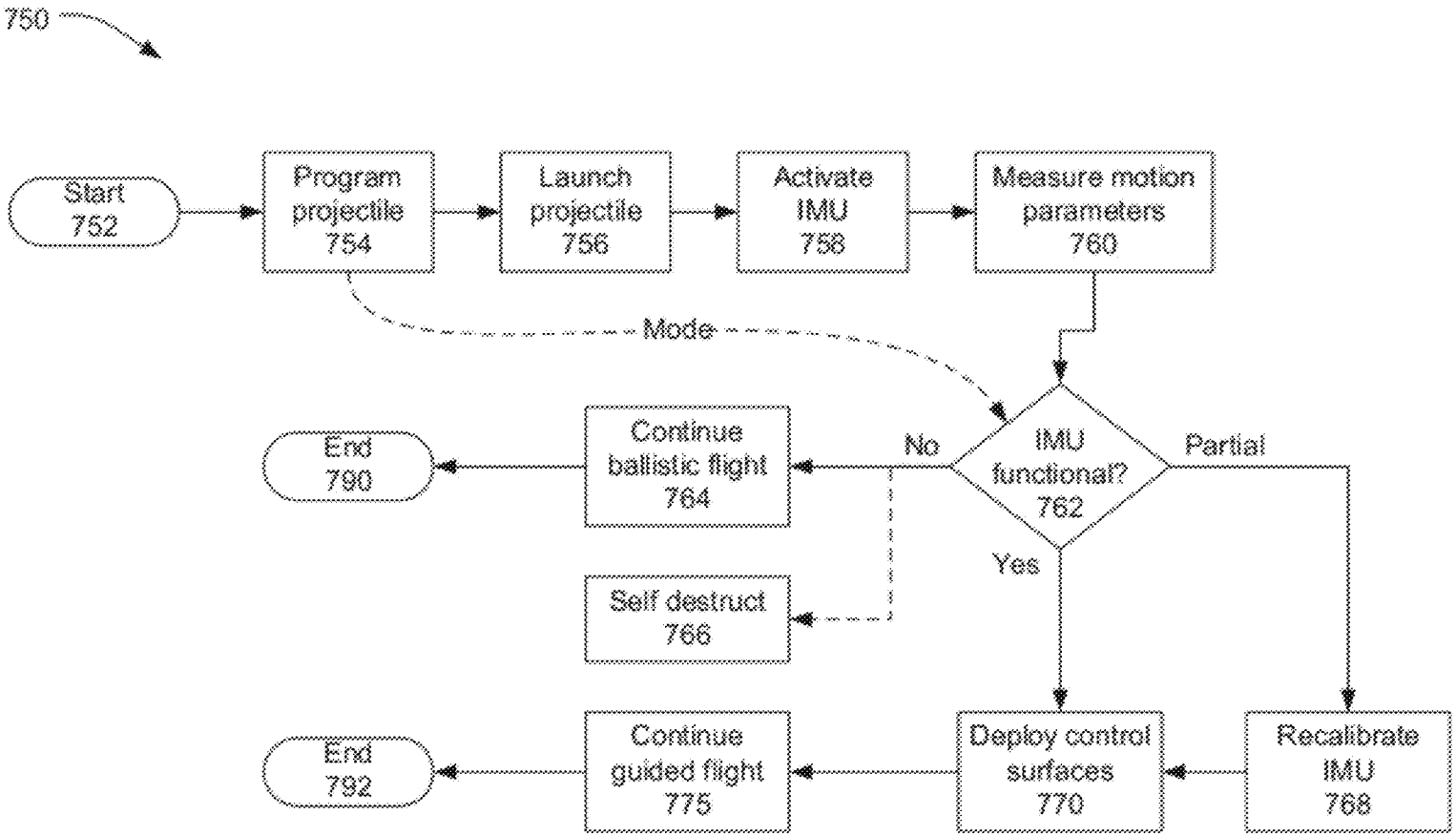
FIG. 7 is a flow chart of a method of operating a guided projectile.

FIG. 7 is a flow chart of a process 750 for operating a guided projectile in a manner that provides enhanced failure detection and that minimizes the probability of a faulty projectile deviating substantially from an intended flight path. The process starts at 752, where the projectile may be in a stand-by state. In the stand-by state, any fins and control surfaces may be stowed generally within the outline of the projectile body or otherwise inactive and an internal inertial measurement unit within the projectile may be inactive. At 754, the projectile may be programmed either before or while the projectile is loaded into an artillery piece or other launcher. Programming the projectile may be accomplished by sending the projectile programming data which may include data indicating an intended target position. The programming data sent to the projectile may also include fuse parameters defining when an explosive payload within the projectile should be detonated. For example, the fuse may be programmed to detonate at a specific altitude above ground level or upon impact. The programming data sent to the projectile may also include a mode parameter indicating if the projectile is being fired on a test range or if the projectile is being fired in a tactical or combat situation. The programming data may be sent to the projectile through a wired connection or through a wireless connection, which may be a magnetic coupling, an RF link, an optical link, or another wireless connection.

The programmed projectile may be launched at 756. After launch, the inertial measurement unit (IMU) may be activated at 758. At 760, shortly after the projectile launch, the projectile may be experiencing deceleration (negative acceleration) along a direction of motion parallel to a longitudinal axis of the projectile and rotation or roll about the longitudinal axis. The IMU, which may be the IMU 220, may have three sensor suites adapted to measure motion parameters with respect to three mutually orthogonal measurement axes, each of which may be oblique to the longitudinal axis of the projectile. Since each axis of the IMU is oblique to the longitudinal axis of the projectile, each sensor suite of the IMU may measure a component of the acceleration along the longitudinal axis and the roll about the longitudinal axis at 760.

At 762, a determination may be made if the inertial measurement unit is functional within predetermined tolerances. Specifically, the acceleration values measured by each of the three sensor suites may be compared to determine if the inertial measurement unit is capable of accurately measuring acceleration along all three measurement axes. In addition, the rotation or angular velocity values measured by each of the three sensor suites may be compared to determine if the inertial measurement unit is capable of accurately measuring rotation and/or rotation rate about all three measurement axes.

For example, the inertial measurement unit may be disposed such that the angles between the three measurement axes and the longitudinal axis of the projectile ($\phi i$, $\phi j$, $\phi k$ as shown in FIG. 2) are equal. In this case, the acceleration measurement portions of the inertial measurement unit may be determined to be functional if the acceleration values measured by each of the three sensor suites are equal within a predetermined acceleration tolerance. Similarly, the rotation/rotation rate measurement portions of the inertial measurement unit may be determined to be functional if the rotation and/or rotation rate values measured by each of the three sensor suites are equal within a predetermined acceleration tolerance. In the case where the angles $\phi i$, $\phi j$, $\phi k$, are not equal, the acceleration and rotation/rotation rate values measured by each sensor suite may be scaled appropriately before comparison.

When a determination is made at 762 that the inertial measurement unit is not functioning within predetermined tolerances, the deployment of the control surfaces of the projectile may be inhibited and the projectile may continue along a ballistic flight path at 764 until the flight terminates at impact at 790. When a determination is made at 762 that the inertial measurement unit is not functioning within predetermined tolerances, the projectile fuse may not be armed such that the flight terminates at 790 with a kinetic impact but without detonation.

Guided projectiles generally do not allocate space for a command receiver and a self-destruct mechanism. However, when a self destruct mechanism is available, and a determination is made at 762 that the inertial measurement unit is not functioning within predetermined tolerances, the projectile may be commanded to self-destruct at 766.

The mode of the projectile, as programmed at 754, may be considered at 762 when determining if the inertial measurement unit is functional. In the test mode, safety may be of paramount importance. Thus, in the test mode, the predetermined tolerance on the data measured by the inertial measurement unit may be very small, such that the projectile continues on a ballistic flight path at 764 if there is even a small error is the relative measurements made by the three sensor suites of the inertial measurement unit. In the tactical mode, the trade-off between the need to complete the projectile's mission and the need for safety may result is looser tolerances on the relative measurements made by the three sensor suites of the inertial measurement unit.

When a determination is made at 762 that the inertial measurement unit is functioning within predetermined tolerances, the control surfaces of the projectile may be deployed at 770 and the projectile may continue along a guided flight path at 775. In the tactical mode, the projectile fuse may be armed, possibly near the anticipated end of the flight, and the flight may terminate by impact or detonation at 792.

In some circumstances, and particularly in the tactical mode, a determination may be made at 762 that the inertial measurement unit is partially functional or functioning but outside required precision. In this case, the inertial measurement unit may be "recalibrated" at 768 in order to continue a guided flight. In this context, "recalibrate" is intended to mean that one or more data parameters measured by the inertial measurement unit may be offset, scaled, estimated, or otherwise processed to allow a guided flight to continue at 770.

Figure 8:
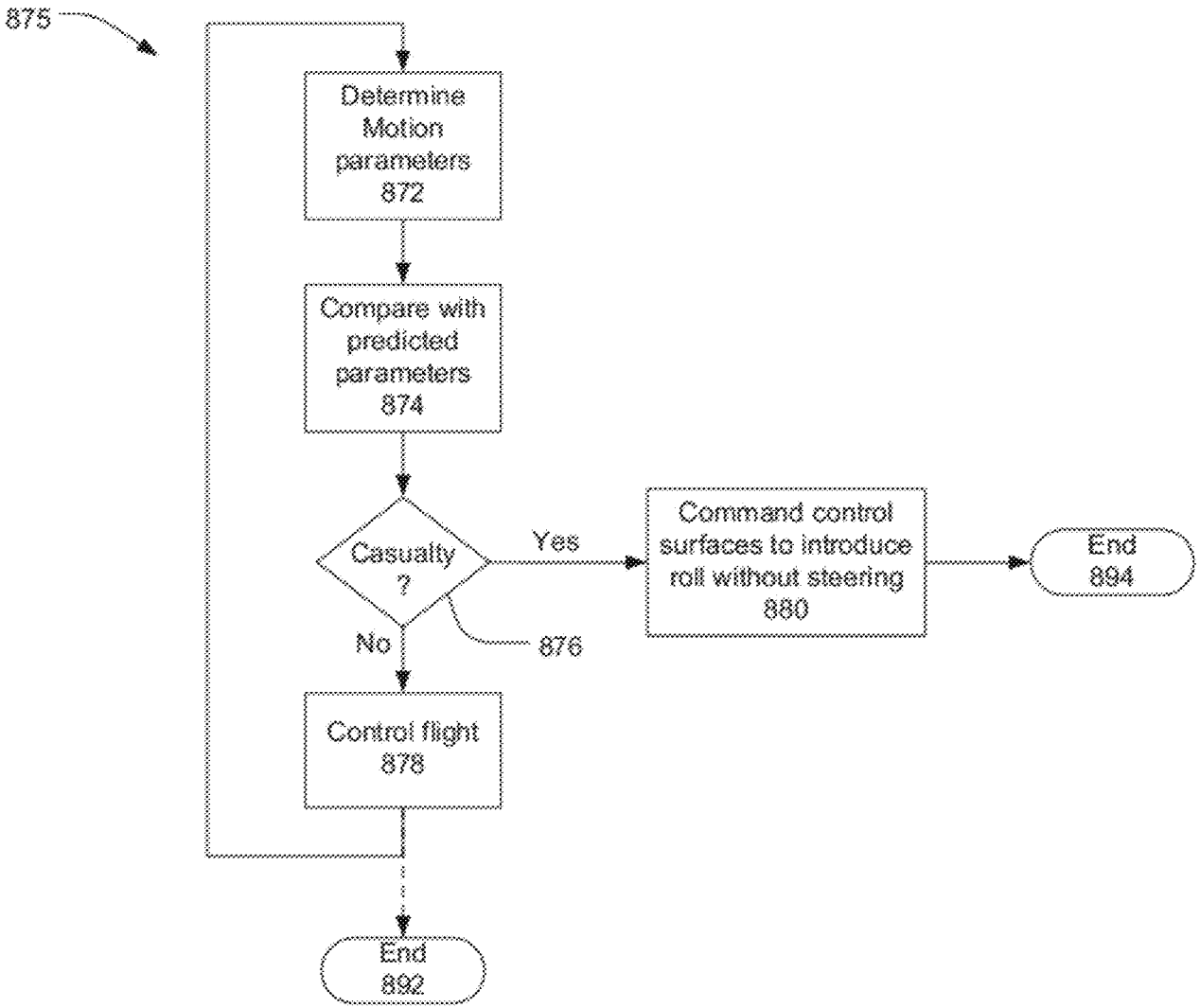
FIG. 8 is a flow chart of a method for a guiding the flight of a projectile.

Referring now to FIG. 8, a process 875 for controlling the flight of a guided projectile may be suitable for use at 775 in FIG. 7.

At 872 motion parameters of the guided projectile may be determined. The motion parameters may include a present position, a velocity vector, and an acceleration vector for the guided projectile. The motion parameters may be determined from one or more data sources such as an inertial measurement unit and a GPS receiver. The motion parameters may be determined with some redundancy. For example, the present position of the projectile may be determined from a GPS receiver and by integrating acceleration and angular rate data measured by an inertial measurement unit. The motion parameters may be filtered or otherwise processed to remove noise.

At 874, the motion parameters determined at 874 may be compared with predicted or desired motion parameters derived from a Kalman filter or other predictive process. The results of this comparison may be used at 878 to provide or adjust commands or signals used to control the flight of the projectile via one or more control surfaces. While the actions at 872, 874, and 878 have been shown as consecutive for ease of explanation, the actions at 872, 874 and 878 may be performed concurrently or nearly concurrently as parts of a real-time closed-loop control system. The real-time control of the projectile may continue until the projectile arrives at or near an intended target at 892.

During the real-time control of the guided projectile, a determination may be made at 876 that the projectile is a casualty, which is to say that the projectile has incurred a failure that prevents the projectile from being accurately guided to the intended target. For example, a substantial difference between a projectile position indicated by the GPS receiver and a projectile position derived from inertial measurements may indicate that one of the navigation systems may have failed. For further example, continued deviation of the projectile from the intended flight path in spite of attempts to control the flight path using the control surfaces may indicate a failure of the control surface actuation system. These and other circumstances may lead to a determination at 876 that the projectile cannot be guided to its intended destination and is a casualty.

When the projectile is determined to be a casualty at 876, the projectile may be placed into a semi-ballistic casualty flight mode at 880. Specifically, at 880, the control surfaces of the projectile may all be commanded to an extreme position in the same direction, with the intention of causing the projectile to roll about its longitudinal axis without introducing any net steering. The effect of one or more erroneously positioned control surfaces may be overwhelmed and rendered moot if a majority of the control surfaces are positioned to cause the projectile to roll. Thus the projectile may be forced to continue in its present direction along a ballistic flight path until the flight terminates in a kinetic impact at 894.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A guided projectile, comprising:

a projectile body an inertial measurement unit disposed within the projectile body, the inertial measurement unit including sensors to measure motion parameters relative to first, second, and third mutually orthogonal axes, wherein each of the first, second, and third mutually orthogonal axes forms a different oblique angle with a longitudinal axis of the projectile body a controller configured to control a trajectory of the guided projectile in response, at least in part, to measurement data received from the inertial measurement unit.

2. The guided projectile of claim 1, wherein the controller is further configured to compare measurement data relative to the first, second, and third, mutually orthogonal axes to determine if the inertial measurement unit is functioning within predetermined tolerances, and inhibit operation of the guided projectile if a determination is made that the inertial measurement unit is not functioning within predetermined tolerances.

3. The projectile of claim 2, wherein the guided projectile may be programmed to operate in one of a test mode and a tactical mode wherein the predetermined tolerances for the test mode are different from the predetermined tolerances for the tactical mode.

4. The guided projectile of claim 2, wherein after launch, the inertial measurement unit measures a component of an initial deceleration of the guided projectile on each of the first, second, and third mutually orthogonal axes, and the controller is configured to compare initial deceleration measurement data from the first, second, and third, mutually orthogonal axes to determine if the inertial measurement unit is functioning within predetermined tolerances.

5. The guided projectile of claim 2, wherein after launch, the inertial measurement unit measures a component of an initial roll of the guided projectile on each of the first, second, and third mutually orthogonal axes, and the controller is configured to compare initial roll measurement data from the first, second, and third, mutually orthogonal axes to determine if the inertial measurement unit is functioning within predetermined tolerances.

6. The guided projectile of claim 2, wherein the guided projectile further comprises a warhead, and the controller is configured to inhibit operation of the guided projectile by inhibiting arming of the warhead.

7. The guided projectile of claim 2, wherein the guided projectile further comprises a plurality of control surfaces stowed within the projectile body before and during launch, and the controller is configured to inhibit operation of the guided projectile by inhibiting extension of the plurality of control surfaces from the projectile body.

8. The guided projectile of claim 2, wherein the guided projectile further comprises a self-destruct mechanism, and the controller is configured to inhibit operation of the guided projectile by initiating self-destruction.

9. The guided projectile of claim 1, wherein the inertial measurement unit comprises first, second, and third accelerometers disposed to measures acceleration along each of the first, second, and third mutually orthogonal axes, respectively.

10. The projectile of claim 1, wherein the inertial measurement unit comprises respective first, second, and third gyroscopes disposed to measure rotation rate about each of the first, second, and third mutually orthogonal axes, respectively.

11. The projectile of claim 1, further comprising:

a GPS receiver wherein the controller is configured to control the trajectory of the guided projectile in response, at least in part, to positional data provided by the GPS receiver.

12. The projectile of claim 1, wherein the angles formed by each of the first, second, and third mutually orthogonal axes and the longitudinal axis of the projectile body are of equal magnitude.

13. A method for operating a guided projectile, comprising:

launching the guided projectile measuring motion parameters relative to first, second, and third mutually orthogonal axes with an inertial measurement unit, wherein each of the first, second and third mutually orthogonal axes forms a different oblique angle with a longitudinal axis of the guided projectile controlling a trajectory of the guided projectile in response, at least in part, to the measured motion parameters.

14. The method of claim 13, further comprising:

comparing measurement data relative to the first, second, and third mutually orthogonal axes to determine if the inertial measurement unit is functioning within predetermined tolerances inhibiting operation of the guided projectile if a determination is made that the inertial measurement unit is not functioning within predetermined tolerances.

15. The method of claim 14, further comprising:

programming the guided projectile to operate in one of a test mode and a tactical mode wherein the predetermined tolerances for the test mode are different from the predetermined tolerances for the tactical mode.

16. The method of claim 14, further comprising:

after launch, measuring a component of an initial deceleration of the guided projectile on each of the first, second, and third mutually orthogonal axes comparing initial deceleration measurement data from the first, second, and third mutually orthogonal axes to determine if the inertial measurement unit is functioning within predetermined tolerances.

17. The method of claim 14, further comprising:

after launch, measuring a component of an initial roll of the guided projectile on each of the first, second, and third mutually orthogonal axes comparing initial roll measurement data from the first, second, and third mutually orthogonal axes to determine if the inertial measurement unit is functioning within predetermined tolerances is performed after launching the projectile.

18. The method of claim 14, wherein the guided projectile comprises a warhead, and the method further comprising inhibiting operation of the guided projectile by inhibiting arming of the warhead.

19. The method of claim 14, wherein the guided projectile comprises a plurality of control surfaces stowed within a projectile body before and during launch, and the method further comprises inhibiting operation of the guided projectile by inhibiting extension of the plurality of control surfaces from the projectile body.

20. The method of claim 14, wherein the guided projectile comprises a self-destruct mechanism, and the method further comprises inhibiting operation of the guided projectile by initiating self-destruction.

21. The method of claim 13, wherein the inertial measurement unit comprises first, second, and third accelerometers disposed to measures acceleration along each of the first, second, and third mutually orthogonal axes, respectively.

22. The method of claim 13, wherein the inertial measurement unit comprises respective first, second, and third gyroscopes disposed to measure rotation rate about each of the first, second, and third mutually orthogonal axes, respectively.

23. The method of claim 13, wherein the guided projectile comprises a GPS receiver the method further comprising controlling the trajectory of the guided projectile in response, at least in part, to positional data provided by the GPS receiver.

24. The method of claim 13, wherein the angles formed by each of the first, second, and third mutually orthogonal axes and the longitudinal axis of the guided projectile are of equal magnitude.

* * * * *